United States Patent [19]

Eriksson

[11] 3,945,519

[45] Mar. 23, 1976

[54] LOADING METHOD

[75] Inventor: Sven Erik Nore Eriksson, Orebro, Sweden

[73] Assignee: Atlas Copco Aktiebolag, Nacka, Sweden

[22] Filed: June 14, 1974

[21] Appl. No.: 479,483

Related U.S. Application Data

[62] Division of Ser. No. 313,129, Dec. 7, 1972, Pat. No. 3,917,089.

[30] Foreign Application Priority Data

Dec. 16, 1971 Sweden ..... 16105/71

[52] U.S. Cl. ..... 214/152

[51] Int. Cl.[2] ..... B65G 65/28

[58] Field of Search ..... 214/145, 146 E, DIG. 5, 214/152; 37/117.5, 118, 127; 198/145

[56] References Cited

UNITED STATES PATENTS

| | | | |
|---|---|---|---|
| 1,415,869 | 5/1922 | Fischer | 198/145 |
| 2,203,713 | 6/1940 | Austin | 37/127 |
| 2,280,941 | 4/1942 | Adams | 198/145 |
| 3,744,165 | 7/1973 | Vickaryous | 37/127 |

*Primary Examiner*—Robert J. Spar
*Assistant Examiner*—Ross Weaver
*Attorney, Agent, or Firm*—Eric Y. Munson

[57] ABSTRACT

A loading machine having two rotatably connected scoops. One of the scoops is, in one of its end positions, received in the other scoop and is thereby directed in the same direction as the other scoop.

6 Claims, 6 Drawing Figures

LOADING METHOD

This is a division of application Ser. No. 313,129, filed Dec. 7, 1972.

BACKGROUND OF THE INVENTION

The present invention concerns a loading machine of the type which comprises a vehicle to which is connected a tiltable load-bucket which can be raised and lowered. The machine according to the invention differs from previously known machines through a scoop being rotatably connected to the load-bucket. This connection is so made that the scoop in one of its end positions is located within the load-bucket. The scoop is thus steered in the same direction as the load-bucket. By reason of this arrangement a substantial increase of the loading capacity is achieved while still maintaining the vehicle dimensions designed for the load-bucket only. When the scoop is filled and locked in a raised position by a hooking device on the vehicle, the filling of the load-bucket is facilitated since the weight of the filled scoop favourably influences the driving capacity of the front wheel-pair. The invention has the characteristics defined in the appended claims.

BRIEF DESCRIPTION OF THE DRAWINGS

One embodiment of the invention will be described below with reference to the attached drawing on which

SUMMARY OF THE INVENTION

Figure 1:
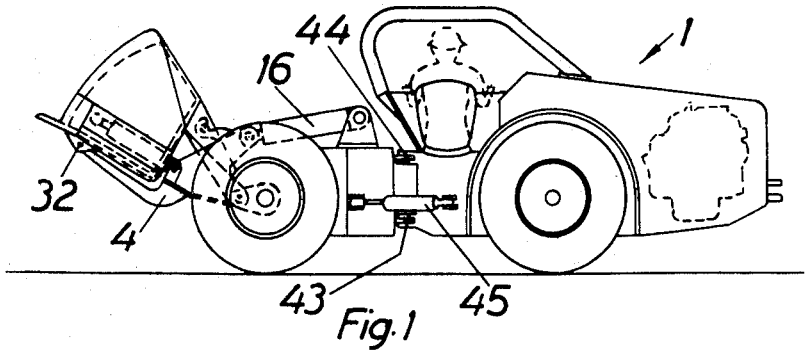
FIG. 1 is a side view of a loading machine with the load-bucket raised to the position where hooking of the scoop occurs.

The loading machine shown on the drawing comprises a centrally steered vehicle 1 which is steered by hydraulic jacks 45. To make the central steering possible the vehicle 1 has central joints 43, 44. Since the design of the vehicle does not form a part of the invention it will not be further described.

Figure 3:
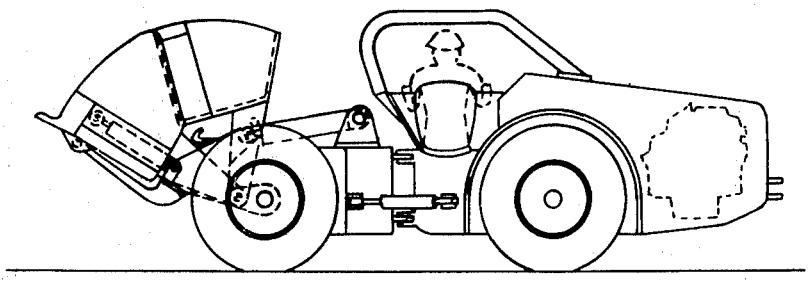
FIG. 3 shows the loading machine with the load-bucket raised and the scoop raised past the hooking position.
Figure 6:
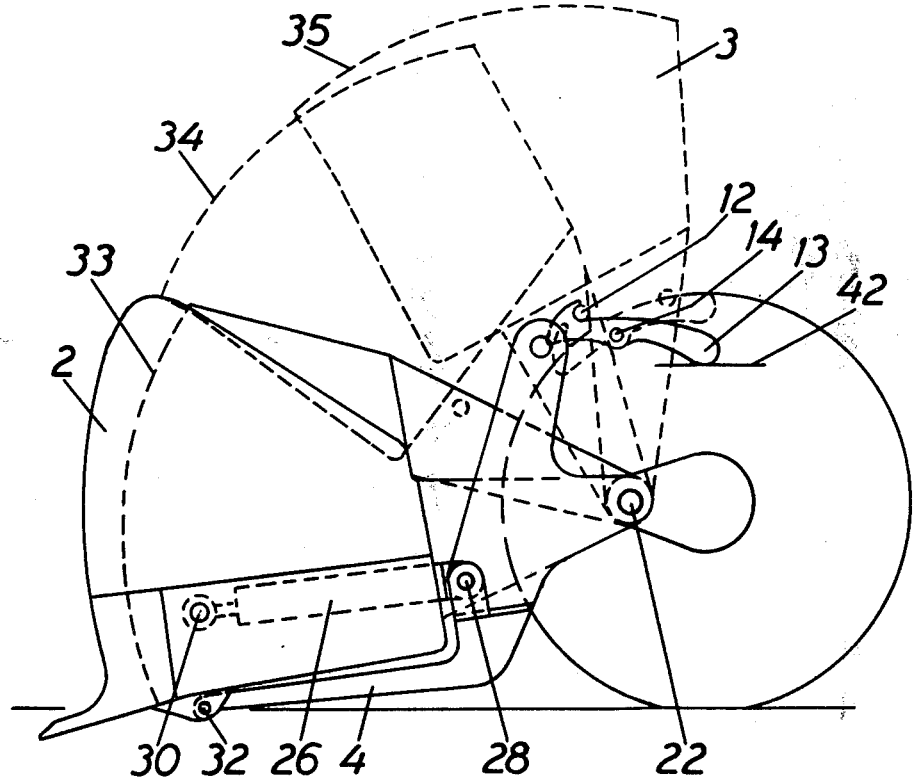
FIG. 6 is a side view of the load-bucket showing the scoop in three positions.

The loading machine is provided with two arms 4, 5 which are rotatably connected to the vehicle 1 through joints 22, of which one is shown. A load-bucket 2 is rotatably carried by the arms 4, 5 through joints 32, of which one is shown. For raising or lowering of the load-bucket 2, the loading machine is provided with two hydraulic jacks 16, 17. The hydraulic jacks 16, 17 are connected to the arms 4, 5 by cylindrical pins 20, 21. The hydraulic jacks 16, 17 are furthermore connected to pivots 18, 19 on the vehicle 1. For tilting of the load-bucket 2 about the joints 32 the loading machine is provided with hydraulic jacks 26, 27. The latter are connected to the load-bucket 2 through joints 30, 31. The hydraulic jacks 26, 27 are furthermore connected to pivots 28, 29, which are mounted on projections 24, 25 on the arms 4, 5. On the side turned towards the vehicle 1, the load-bucket 2 is provided with two brackets 8, 9, which through joints 10, 11 are connected to brackets 6, 7 on a scoop 3. A cylindrical rod 12 extends between the brackets 6, 7 on the scoop 3. A hook 13 is pivotally connected to braces 15 on the vehicle 1 by means of a pin 14. The hook 13 is adapted to cooperate with the rod 12 for hooking of the scoop 3. In order to achieve a simple automatic hooking of the scoop the pivot pin 14 of the hook 13 has been so located that the hook 13 by force of gravity will return to the position 42 in which position hooking of the scoop 3 occurs. The load-bucket 2 is so designed that the scoop 3 in one of its end positions is located within the load-bucket 2. The scoop 3 is thus steered in the same direction as the load-bucket. This position has in FIG. 6 been given the reference numeral 33. When the load-bucket 2 is raised so that the scoop 3 is moved from the position 33 to the position 34 the scoop 3 is automatically hooked and locked in position. This hooking action is produced by the rod 12 removing the hook 13 from the position shown at 42, in FIG. 6. When the rod 12 has passed the hook 13 the latter swings back by force of gravity to the position shown at 42. The position 35 of the scoop 3 corresponds to the position which the scoop takes in FIG. 3.

Figure 2:
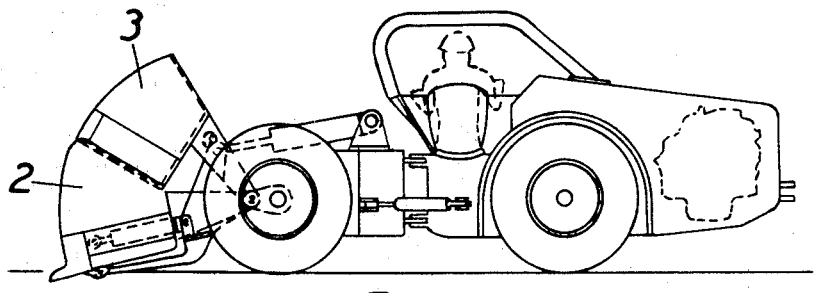
FIG. 2 shows the loading machine with the load-bucket lowered and the scoop hooked.
Figure 4:
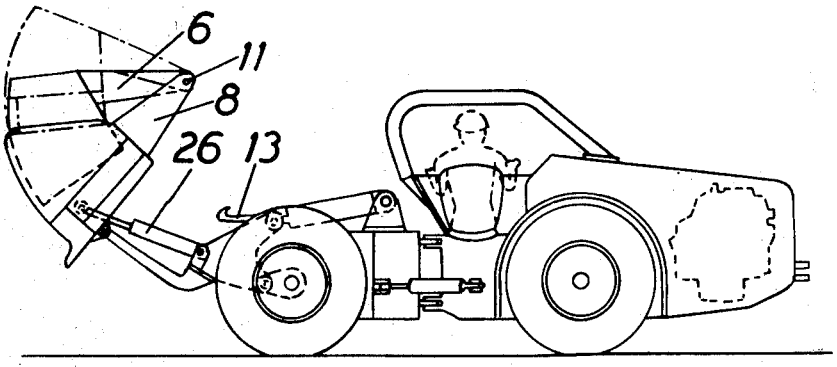
FIG. 4 shows the loading machine with the load-bucket and the scoop in dumping position.
Figure 5:
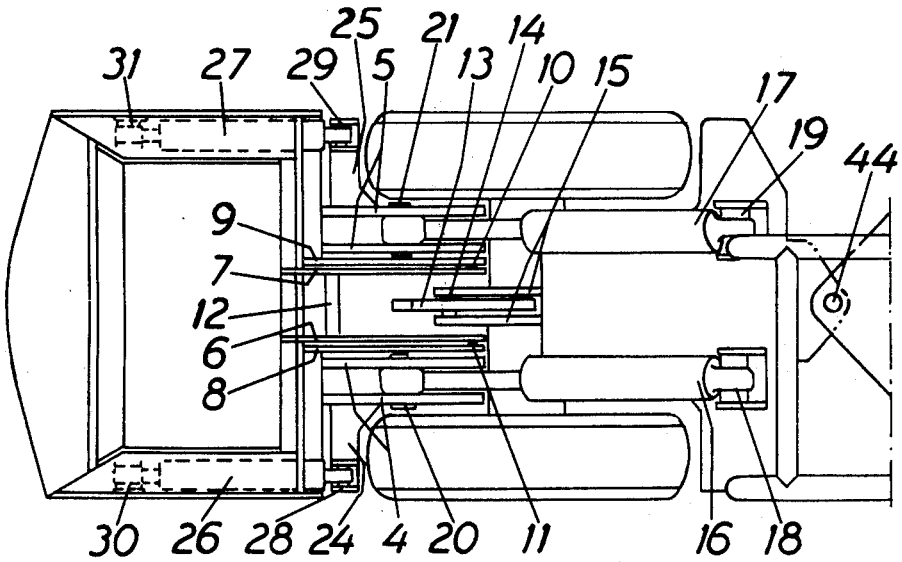
FIG. 5 is a top plan view of the front part of the loading machine.

The loading machine shown on the drawing operates in the following manner. In the starting position the scoop 3 is located within the load-bucket 2. After the scoop 3 is filled, the load-bucket has been raised to the extent necessary for the scoop 3 to be hooked and locked in position by the hook 13. This position is shown in FIG. 1. Thereafter the load-bucket 2 is lowered to the position shown in FIG. 2, and filled. The load-bucket 2 is then again raised to the position shown in FIG. 3, whereby the scoop 3 is raised further by the material in the load-bucket 2 so that the rod 12 will become disengaged from the hook 13. The loading machine is thereafter driven to a dumping place where the load-bucket 2, through the action of the hydraulic jacks 26, 27, is tilted about the joints 32. This position is shown in FIG. 4. As the material is discharged from the load-bucket 2, the scoop 3 is swung about the joints 10, 11 into the load-bucket 2, in turn and emptied. In order to facilitate the emptying process the hydraulic jacks 26, 27 or the hydraulic jacks 16, 17 or eventually all can be supplied with hydraulic fluid, the pressure of which pulsates so that the load-bucket 2 and the scoop 3 are subject to vibrations. The loading machine is furthermore suitably provided with means for preventing the scoop 3 to tilt towards the driver's cabin.

The above described and on the drawing shown embodiment of the invention is only to be regarded as an example which can be modified within the scope of the subsequent claims.

What I claim is:

1. A method of loading, transporting and discharging material obtaining increased capacity comprising:

positioning a scoop to be nested within a load bucket connected to arm means pivotally connected to a load transporting vehicle, raising and lowering the arm means for selectively positioning the load bucket, steering the load bucket and scoop therein toward the material to be loaded and loading material into the scoop, raising the scoop to a raised position by raising the load bucket to a selected position, retaining the scoop in the raised position while lowering the load bucket to unnest the scoop from within the load bucket, loading material into the load bucket, and transporting the loaded material and discharging the same from the scoop and from the load bucket.

2. A method of loading, transporting and discharging material as claimed in claim 1, wherein discharging the material comprises the steps of tilting the load bucket and the scoop relative to the arm means to discharge material therefrom.

3. A method for loading with a bucket loading machine having a load bucket connected to a vehicle for transporting the loaded material comprising:

swinging the load bucket along an arc, in a vertical plane, from a material loading position to a transporting position, swinging a scoop mounted on the vehicle along the arc, nesting the scoop within the load bucket when in a material loading position, loading the scoop, raising the scoop to a predetermined position by upwardly swinging the load bucket, retaining the scoop in the predetermined position, swinging the load bucket downward to a material loading position, and loading the bucket.

4. A method as claimed in claim 3 further comprising the steps of swinging the loaded bucket upward to a position for transporting the loaded material by the vehicle, releasing the scoop through engagement with the loaded material in the load bucket as it swings upward to a position for transporting the material by the vehicle, tilting the load bucket to discharge loaded material therefrom, tilting the scoop through the discharge of material from the load bucket to discharge the material from the scoop.

5. A method of loading, transporting and discharging material obtaining increased capacity comprising:

positioning a scoop to be nested within a load bucket connected to arm means pivotally connected to a load transporting vehicle, raising and lowering the arm means for selectively positioning the load bucket, steering the load bucket and scoop therein toward the material to be loaded and loading material into the scoop, raising the scoop so that the scoop is no longer nested within the load bucket, loading material into the load bucket, transporting the loaded material, discharging the material by tilting the load bucket relative to the arm means to discharge material therefrom, and tilting the scoop as a result of the discharge of material from the load bucket to discharge the material from the scoop.

6. A method of loading, transporting and discharging material as claimed in claim 5 wherein the scoop is raised by raising the load bucket.

* * * * *